US006940245B2

(12) United States Patent
Scarlet et al.

(10) Patent No.: US 6,940,245 B2
(45) Date of Patent: Sep. 6, 2005

(54) DOWNHOLE COMPRESSOR SYSTEM WITH A FEEDBACK SENSOR

(75) Inventors: Jeremy Adam Scarlet, Fleet (GB); Roger Sidey, East Twickenham (GB)

(73) Assignee: Corac Group PLC, Uxbridge (GB)

( * ) Notice: Subject to any disclaimer, the term of this patent is extended or adjusted under 35 U.S.C. 154(b) by 0 days.

(21) Appl. No.: 10/794,124

(22) Filed: Mar. 5, 2004

(65) Prior Publication Data

US 2004/0174127 A1 Sep. 9, 2004

(30) Foreign Application Priority Data

Mar. 6, 2003 (GB) ..... 0305090

(51) Int. Cl.[7] ..... E21B 43/12
(52) U.S. Cl. ..... 318/463; 417/24; 175/101
(58) Field of Search ..... 318/461–465; 175/92, 101; 414/22–24, 44.1, 321, 410.1

(56) References Cited

U.S. PATENT DOCUMENTS

| | | | | |
|---|---|---|---|---|
| 3,188,620 A | | 6/1965 | MacCallum | |
| 3,447,034 A | | 5/1969 | Smith | |
| 3,742,264 A | * | 6/1973 | Anderson et al. | 310/42 |
| 3,868,521 A | * | 2/1975 | Schlicker et al. | 310/257 |
| 4,100,528 A | * | 7/1978 | Bernard et al. | 367/83 |
| 4,167,000 A | * | 9/1979 | Bernard et al. | 367/84 |
| 4,178,579 A | * | 12/1979 | McGibbeny et al. | 340/853.3 |
| 4,365,506 A | * | 12/1982 | Hyde | 73/152.61 |
| 4,461,994 A | * | 7/1984 | MacDonald | 324/174 |
| 4,553,093 A | * | 11/1985 | Chikasue | 324/169 |
| 4,798,247 A | * | 1/1989 | Deaton et al. | 166/66.7 |
| 4,841,187 A | | 6/1989 | Hauke et al. | |
| 4,971,522 A | * | 11/1990 | Butlin | 417/18 |
| 5,004,981 A | | 4/1991 | Hashimoto et al. | |
| 5,142,180 A | | 8/1992 | Moore et al. | |
| 6,414,455 B1 | * | 7/2002 | Watson | 318/432 |

FOREIGN PATENT DOCUMENTS

| | | |
|---|---|---|
| EP | 0 287 937 | 4/1988 |
| GB | 1 306 100 | 2/1973 |
| GB | 2 163 856 | 3/1986 |

* cited by examiner

*Primary Examiner*—Bentsu Ro
(74) *Attorney, Agent, or Firm*—Jon A. Gibbons; Fleit, Kain, Gibbons, Gutman, Bongini & Bianco P.L.; Alec Messulam

(57) ABSTRACT

A downhole compressor system is disclosed for assisting in extracting gas from the well. The system comprises a compressor 14, an electric motor 10 for driving the compressor 14 which motor has a stator winding and a rotor 12 and, in use, is lowered into the well together with the compressor. A control system 18, which when in use is disposed outside the well, is connected to the stator winding for controlling the current supply to the motor 10. The control system 18 receiving a signal indicative of the speed and phase of the rotor from a feedback sensor 16 mounted for rotation with the rotor 12. In the invention, the feedback sensor is a current generator having a permanent magnet 16*a* mounted for rotation with the rotor 12 and a second stator winding 16*b* connected to the control system 18.

12 Claims, 1 Drawing Sheet

DOWNHOLE COMPRESSOR SYSTEM WITH A FEEDBACK SENSOR

CROSS-REFERENCE TO RELATED APPLICATIONS

This application is based upon and claims priority from prior British Patent Application No. 0305090.3, filed on Mar. 6, 2003, the entire disclosure of which is herein incorporated by reference.

FIELD OF THE INVENTION

The present invention generally relates to a downhole compressor system and more particularly to a downhole compressor system for assisting in extracting gas from the well.

BACKGROUND OF THE INVENTION

It is known to control various types of electric motor using a closed feedback loop to maintain a desired rotor speed and/or phase. For example, during operation of a high speed permanent magnet motor, the motor is fed with a single or multiphase current waveform via a variable frequency device. At start up the motor can be rotated synchronously by feeding a current wave from the variable frequency device to the motor windings, but at higher speeds and loads a rotary position signal relative to the motor shaft is required from a feedback sensor to commutate the motor and thus prevent the motor dropping out of synchronization. In addition a velocity signal needs to be derived from the position signal to control the speed of the machine.

Conventional position feedback sensors for a rotating shaft include Hall-effect devices, optical encoders, resolvers or cam wheel/displacement probes. However, when controlling the motor of a downhole compressor arranged in a gas production well, it is essential to employ components that are capable of withstanding the hostile environment and conventional feedback sensors would not be suitable as they tend to be limited in their temperature capability.

Conventional feedback sensors require a signal processor or driver to be able to transmit their feedback signal over long distances, it being noted that the control system and the sensor are connected to one another by a conductor extending down the well, the depth of which can often be measured in kilometers.

According what is needed is a method and system to over come the problems encountered in the prior art and to provide a feedback sensor used in a downhole compressor system with greater temperature capabilities and the elimination of signal processors and drivers to transmit feedback signals over long distances.

SUMMARY OF THE INVENTION

Briefly, in accordance with the invention, a feedback sensor used in a downhole compressor system of the present invention is a current generator having a permanent magnet mounted for rotation with the rotor and a second stator winding connected to the control system.

A primary advantage of the use of a generator as a feedback sensor is that it provides a sinusoidal waveform with a low harmonic content which can be transmitted to a remotely located control system with minimal distortion. The phase of the sinusoidal output signal of the sensor indicates the angular position of the rotor while its frequency is indicative of the speed of the rotor.

A further advantage of the use of a generator with a rotating permanent magnet is that it can provide an indication of rotor temperature. Magnets of the type used in an electrically driven compressor have a predictable variation of the magnetic flux density with temperature. Thus by comparing the amplitude of the output signal of the generator with a reference amplitude at the same rotor speed and a known temperature, it is possible to provide an estimate of the temperature of the magnet mounted on the rotor.

A still further advantage of the use of a generator as a feedback sensor is that by appropriate choice of the number of poles and stator windings to achieve a multiple number of cycles of the output signal per revolution of the rotor, it is possible to sense vibration of the rotor by comparing the amplitudes of peaks in the sensor output signal produced during the same revolution of the rotor.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention will be apparent from the following detailed description taken in conjunction with the accompanying drawings in which:

DESCRIPTION OF THE PREFERRED EMBODIMENTS

It should be understood that these embodiments are only examples of the many advantageous uses of the innovative teachings herein. In general, statements made in the specification of the present application do not necessarily limit any of the various claimed inventions. Moreover, some statements may apply to some inventive features but not to others. In general, unless otherwise indicated, singular elements may be in the plural and vice versa with no loss of generality.

The invention is particularly applicable to a downhole compressor system comprising a compressor driven by a permanent magnet motor and the ensuing description will be made by reference to such an embodiment of the invention. It should however be stressed that the electric motor need not necessarily have a permanent magnet motor and that other motor types have been shown to advantageously used in the present invention. Other motor types within the true scope and spirit of the present invention include AC Motors, DC Motors, Brushless DC Motors, Servo Motors, Brushed DC Servo Motors, Brushless AC Servo Motors, Stepper Motors, and combinations thereof.

Figure 1A:
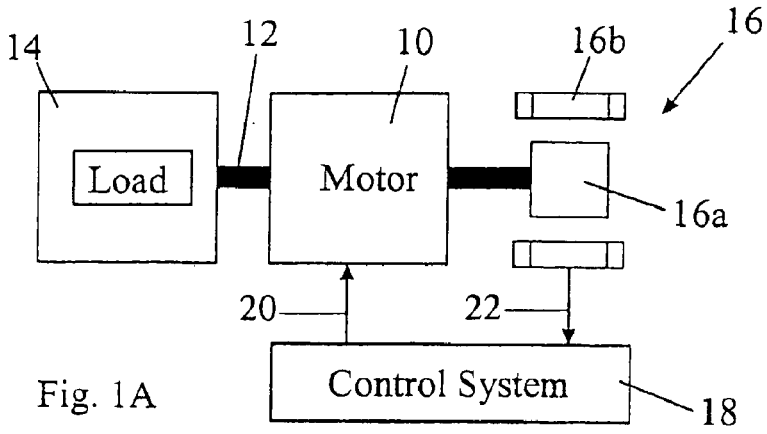
FIG. 1A is a schematic side view of a downhole compressor system embodying the invention.
Figure 1B:
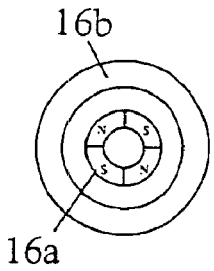
FIG. 1B is a schematic end view of the feedback generator in FIG. 1A.

In FIGS. 1A and 1B, there is shown schematically a gas compressor 14 for use in a gas production well to assist in extracting the gas. The compressor 14 is connected to be driven by the rotor 12 of an electric motor 10 which has permanent magnets mounted on the rotor and a wound stator to which electrical power is supplied by a control, system 18.

It is not possible for economic reasons to service a downhole compressor after it has been installed. It is therefore of vital importance for all the equipment lowered into the well to be reliable and capable of withstanding the hostile environment. These considerations also dictate that only essential components should be lowered into the well to minimize the risk of component failure and to maximize the number of parts that can be serviced after installation. Consequently, the control system 18 is mounted near the mouth of the well and connected to the motor 10 through a cable 20, which can be several kilometers in length, that is lowered into the gas well.

The control system 18 is required to regulate the speed of the compressor for the reasons outlined previously. The control system 18 operates in a closed loop feedback mode and therefore requires a feedback signal that is indicative of the angular position and speed of the rotor 12.

As the sensor used to provide the feedback signal needs to be mounted on the rotor 12, it is necessary also for the signal from the sensor to be transmitted over a long cable 22 back to the control system 18.

To meet these onerous demands on the feedback sensor, the preferred embodiment of the present invention proposes the use as a feedback sensor of a generator 16 that is constructed in a very similar manner to the permanent magnet motor 10. In particular, the generator 16 has permanents magnets 16*a* mounted on the rotor 12 and a wound stator in which a signal is induced by the rotating field of the magnets 16*a*.

The output signal of the generator is an approximately sinusoidal signal with a fixed number of cycles per revolution of the motor dependent upon the number of magnetic poles. Thus the phase of the output waveform is directly dependent upon the angular position of the rotor 12 and the signal frequency is indicative of the rotor speed.

Because the signal is a high power sinusoidal signal with low harmonic content, it is capable of being transmitted over a long cable 22 to the control system without undergoing severe distortion.

Figure 2:
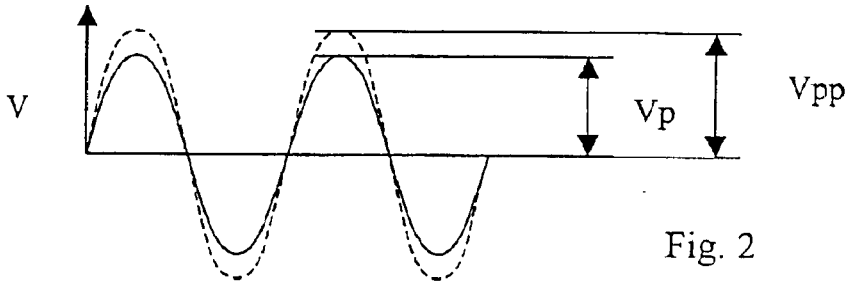
FIG. 2 is a graph demonstrating the effect of temperature upon the amplitude of the output signal of the generator.

The amplitude of the feedback signal will vary with temperature because the strength of a permanent magnet is affected by temperature. This can be used to advantage to provide an indication of the temperature of the rotor. In FIG. 2, the waveform shown in a solid line represents the output signal of the generator 16. The waveform drawn in dotted lines shows for reference the corresponding output of the generator when the rotor is at ambient pressure. As the temperature of the rotor rises, the amplitude of the peaks V" will drop relative to the reference amplitude V. By using a suitable algorithm or a look-up table it is possible from the value of the amplitude Vp at any given frequency to estimate the rotor temperature.

Figure 3:
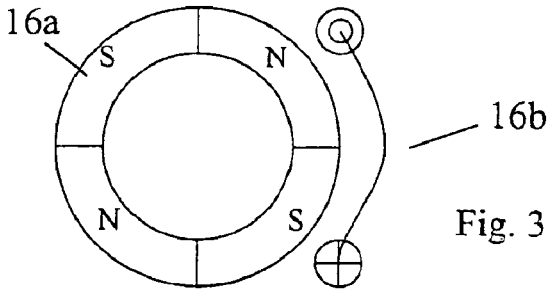
FIG. 3 is a schematic representation of a generator having two pair of magnetic poles and a stator winding spanning a single pole pair.
Figure 4:
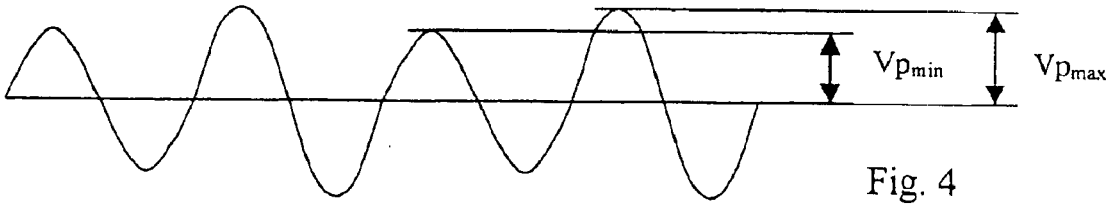
FIG. 4 shows the effect of vibration of the rotor on the waveform of the output signal of the feedback sensor shown in FIG. 3.

FIG. 3 shows schematically a generator having a rotor with two pairs of north-south magnetic poles 16*a* and a stator winding 16*b* that spans a single pair of poles. If the rotor should vibrate as it turns due to an imbalance, the distance between the rotor and the stator of the generator will increase and decrease cyclically resulting in the waveform shown in FIG. 4 in which the signal peaks in the same cycle are not of constant amplitude. In this case, the difference between the amplitude of the peaks Vpmin and Vpmax provides an indication of the vibration.

The control system can in this way detect remotely if the motor is overheating or vibrating excessively and it can if necessary take action to prevent permanent damage to the rotor. For example, the motor may be shut down for a time if it is overheating or its speed may be modified by the control system to avoid a resonance peak.

Although a specific embodiment of the present invention has been disclosed, it will be understood by those having skill in the art that changes can be made to this specific embodiment without departing from the spirit and scope of the present invention. The scope of the present invention is not to be restricted, therefore, to the specific embodiment, and it is intended that the appended claims cover any and all such applications, modifications, and embodiments within the scope of the present invention.

What is claimed is:

1. A downhole compressor system for assisting in extracting gas from the well, the system comprising:

a compressor;

an electric motor for driving the compressor, wherein the motor has a stator winding and a rotor and, in use, the motor is lowered into the well together with the compressor;

a control system connected to the stator winding for controlling the current supply to the motor, which control system, in use, is disposed outside the well; and a feedback sensor mounted for rotation with the rotor for supplying to the control system a signal indicative of the phase and speed of rotation of the rotor, characterized in that the feedback sensor is a current generator having a permanent magnet mounted for rotation with the rotor and a second stator winding disposed in the motor and connected to the control system.

2. The compressor system as claimed in claim 1, wherein the control system further comprises:

means for comparing an amplitude of an output signal of the generator with a reference amplitude at a same rotor speed and a known temperature, to provide an estimate of a temperature of the rotor.

3. The compressor system as claimed in claim 2, wherein the generator is operative to produce a sinusoidal output signal having a frequency that is a whole number multiple of a frequency of rotation of the rotor; and wherein the system further comprises:

means for comparing at least two amplitudes of signal cycles generated during a same revolution of the rotor in order to detect vibration of the rotor.

4. The compressor system as claimed in claim 3, wherein the motor comprises a permanent magnet mounted on the rotor.

5. The compressor system as claimed in claim 3, wherein the motor is selected from a group of motor types consisting of AC Motors, DC Motors, Brushless DC Motors, Servo Motors, Brushed DC Servo Motors, Brushless AC Servo Motors, and Stepper Motors.

6. The compressor system as claimed in claim 2, wherein the motor comprises a permanent magnet mounted on the rotor.

7. The compressor system as claimed in claim 2, wherein the motor is selected from a group of motor types consisting of AC Motors, DC Motors, Brushless DC Motors, Servo Motors, Brushed DC Servo Motors, Brushless AC Servo Motors, and Stepper Motors.

8. The compressor system as claimed in claim 1, wherein the generator is operative to produce a sinusoidal output signal having a frequency that is a whole number multiple of a frequency of rotation of the rotor; and wherein the system further comprises:

means for comparing at least two amplitudes of signal cycles generated during a same revolution of the rotor in order to detect vibration of the rotor.

9. The compressor system as claimed in claim 8, wherein the motor comprises a permanent magnet mounted on the rotor.

10. The compressor system as claimed in claim 8, wherein the motor is selected from a group of motor types consisting of AC Motors, DC Motors, Brushless DC Motors, Servo Motors, Brushed DC Servo Motors, Brushless AC Servo Motors, and Stepper Motors.

11. The compressor system as claimed in claim 1, wherein the motor comprises a permanent magnet mounted on the rotor.

12. The compressor system as claimed in claim 1, wherein the motor is selected from a group of motor types consisting of AC Motors, DC Motors, Brushless DC Motors, Servo Motors, Brushed DC Servo Motors, Brushless AC Servo Motors, and Stepper Motors.

* * * * *